US008203524B2

(12) United States Patent
Yoshida et al.

(10) Patent No.: US 8,203,524 B2
(45) Date of Patent: Jun. 19, 2012

(54) LIGHT-EMITTING ELEMENT DRIVING CIRCUIT

(75) Inventors: Tomoshi Yoshida, Hyogo-ken (JP); Nobuyuki Ohtaka, Kadoma (JP)

(73) Assignees: Sanyo Electric Co., Ltd., Osaka (JP); Sanyo Semiconductor Co., Ltd., Gunma (JP)

( * ) Notice: Subject to any disclaimer, the term of this patent is extended or adjusted under 35 U.S.C. 154(b) by 412 days.

(21) Appl. No.: 12/557,128

(22) Filed: Sep. 10, 2009

(65) Prior Publication Data

US 2010/0060674 A1 Mar. 11, 2010

(30) Foreign Application Priority Data

Sep. 10, 2008 (JP) ..... 2008-231948
Sep. 10, 2008 (JP) ..... 2008-231949
Sep. 10, 2008 (JP) ..... 2008-231950

(51) Int. Cl.
*G09G 3/36* (2006.01)

(52) U.S. Cl. ..... 345/102; 345/207

(58) Field of Classification Search ..... None
See application file for complete search history.

(56) References Cited

U.S. PATENT DOCUMENTS 7,312,783 B2 * 12/2007 Oyama ..... 345/102
2005/0190142 A1 * 9/2005 Ferguson ..... 345/102
2005/0231263 A1 10/2005 Kawai
2006/0072324 A1 * 4/2006 Hachiya et al. ..... 362/270
2007/0070002 A1 * 3/2007 Fujita et al. ..... 345/87

FOREIGN PATENT DOCUMENTS

JP 2005-310854 11/2005

OTHER PUBLICATIONS esp@cenet patent abstract for Japanese Publication No. 2005310854, Publication date Nov. 4, 2005 (1 page).

* cited by examiner

*Primary Examiner* — Christopher R Lamb
(74) *Attorney, Agent, or Firm* — Osha • Liang LLP

(57) ABSTRACT

A light-emitting element driving circuit (10) comprises a luminosity determining unit (70) which determines luminosity, outputs a luminosity determination result, and outputs brightness change information, a brightness setting unit (60) which outputs brightness setting information and outputs brightness change information, a light-emitting element driving unit (40) which drives a light-emitting element with a current of a current value corresponding to the brightness setting information, a detecting and comparing unit (50) which compares a terminal voltage of the light-emitting element and a predetermined voltage, a voltage boost determining unit (30) which determines whether or not a terminal voltage of the light-emitting element is to be boosted based on at least one of the luminosity change information and the brightness change information, and a voltage boosting circuit section (20) which boosts the terminal voltage of the light-emitting element when it is determined that the voltage is to be boosted and does not boost the terminal voltage of the light-emitting element when it is determined that the voltage is not to be boosted.

4 Claims, 12 Drawing Sheets

LIGHT-EMITTING ELEMENT DRIVING CIRCUIT

CROSS-REFERENCE TO RELATED APPLICATIONS

This application claims priority from Japanese Patent Application Nos. 2008-231948, 2008-231949, and 2008-231950 filed on Sep. 10, 2008, the entire disclosure of which is incorporated herein by reference.

BACKGROUND OF THE INVENTION

1. Field of the Invention

The present invention relates to a light-emitting element driving circuit, and in particular, to a light-emitting element driving circuit which changes brightness of a light-emitting element.

2. Description of the Related Art

In recent years, there are more occasions where a video image such as one-segment broadcasting is viewed on a main liquid crystal display of a portable phone, and a light-emitting element driving circuit which changes the brightness of the backlight of the liquid crystal is sometimes equipped in the portable phone. The light-emitting element driving circuit applies an automatic adjustment of the brightness of the backlight of the liquid crystal corresponding to the ambient luminosity, in order to optimize the visibility. More specifically, the light is adjusted such that the brightness of the backlight is increased to achieve brighter display when the ambient environment is bright and the brightness of the backlight is reduced to achieve darker display when the ambient environment is dark, so that the visibility is optimized. JP 2005-310854 A discloses a driving circuit which applies brightness adjustment of a light-emitting element.

In addition, a main liquid crystal screen is provided on a portable phone, and when a key button or the like of the portable phone is operated when the main liquid crystal screen is viewed, the backlight is set in the high brightness (normal mode) and a bright screen is achieved. When a state of no operation is continued, the main liquid crystal screen is automatically set to the low brightness (slight emission mode) and a dark screen is realized, to inhibit the current consumption. JP 2005-310854 A discloses a drive circuit which applies brightness adjustment of a light-emitting element.

Moreover, as described above, because there are more occasions where an video image such as one-segment broadcasting is viewed on the main liquid crystal display of the portable phone, a light-emitting element driving circuit which changes brightness of the backlight of the liquid crystal is sometimes equipped in the portable phone. In the light-emitting element driving circuit, a control to change the brightness of the backlight of the liquid crystal according to content of the video image signal is applied in order to display a clear image with a superior contrast. More specifically, the light is adjusted such that a bright image is displayed brighter with the brightness of the backlight increased and a dark image is displayed darker with the brightness of the backlight reduced. JP 2005-310854 A discloses a driving circuit which applies brightness adjustment of the light-emitting element.

However, when the current value of current flowing through the backlight is increased in order to increase the brightness of the backlight corresponding to the ambient environment becoming brighter, a forward voltage (Vf)) of the backlight is increased, and the terminal voltage of the cathode terminal of an LED forming the backlight is reduced. When the terminal voltage of the cathode terminal is reduced to a value less than a set voltage, a voltage boosting circuit is activated to boost the terminal voltage of the anode terminal. However, there may be cases where, after the voltage is once boosted, for example, the ambient environment becomes darker, the current value of the current flowing in the backlight is reduced in order to reduce the brightness of the backlight, and the forward voltage (Vf)) of the backlight is reduced. In such a case, although the terminal voltage of the cathode terminal of the LED is increased, the voltage boosting circuit may still be in an operating state, and consequently, a wasteful current consumption is caused.

Moreover, during the normal mode, the brightness is high. When the current value of the current flowing in the backlight is increased in order to increase the brightness of the backlight, the forward voltage (Vf)) of the backlight is increased, and the terminal voltage of the cathode terminal of the LED forming the backlight is reduced. Similar to the above, when the terminal voltage of the cathode terminal is reduced to a value less than the set voltage, the voltage boosting circuit is activated and the terminal voltage of the anode terminal is boosted. However, there may be cases where, after the voltage is once boosted, for example, the device is set in the slight emission mode (low brightness), the current value of the current flowing in the backlight is reduced in order to reduce the brightness of the backlight, and the forward voltage (Vf)) of the backlight is reduced. In such cases, if the voltage boosting circuit is in the operating state even after the terminal voltage of the cathode terminal of the LED is increased, wasteful current consumption is caused.

Furthermore, when the brightness is increased for a bright image, the current value of the current flowing in the backlight is increased in order to increase the brightness of the backlight, the forward voltage (Vf) of the backlight is increased, and, consequently, the terminal voltage of the cathode terminal of the LED forming the backlight is reduced. Again, when the terminal voltage of the cathode terminal is reduced to a value less than the set voltage, the voltage boosting circuit is activated to boost the terminal voltage of the anode terminal. However, there may be cases where, after the voltage is once boosted, for example, the brightness is reduced for a dark image, the current value of the current flowing in the backlight is reduced in order to reduce the brightness of the backlight, and the forward voltage (Vf) of the backlight is reduced. In such cases, if the voltage boosting circuit is in the operating state even after the terminal voltage of the cathode terminal of the LED is increased, wasteful current consumption is caused.

SUMMARY OF THE INVENTION

An advantage of the present invention is that a light-emitting driving circuit which enables efficient operation of a voltage boosting circuit is provided.

According to one aspect of the present invention, there is provided a light-emitting element driving circuit comprising a luminosity determining unit which acquires luminance information from a luminance sensor, determines luminosity, outputs a luminosity determination result, and outputs luminosity change information, a brightness setting unit which sets brightness based on the luminosity determination result of the luminosity determining unit, outputs brightness setting information, and outputs brightness change information, a light-emitting element driving unit which drives a light-emitting element with a current of a current value corresponding to the brightness setting information from the brightness setting unit, a detecting and comparing unit which detects a terminal voltage of a first terminal of the light emitting element and compares with a predetermined voltage, a voltage boost determining unit which determines whether or not a terminal voltage of a second terminal of the light-emitting element is to be boosted based on at least one of the luminosity change information and the brightness change information, and an output of the detecting and comparing unit, and a voltage boosting circuit section which boosts the terminal voltage of the second terminal of the light-emitting element when the voltage boost determining unit determines that the voltage is to be boosted, and which does not boost the terminal voltage of the second terminal of the light-emitting element when the voltage boost determining unit determines that the voltage is not to be boosted.

According to another aspect of the present invention, there is provided a light-emitting element driving circuit comprising a light emission mode setting unit which sets a light emission mode of a light-emitting element based on a light emission mode signal from a central processing unit, outputs light emission mode setting information, and outputs light emission mode change information, a light-emitting element driving unit which drives the light-emitting element with a current of a current value corresponding to the light emission mode setting information from the light emission mode setting unit, a detecting and comparing unit which detects a terminal voltage of a first terminal of the light-emitting element and compares with a predetermined voltage, a voltage boost determining unit which determines whether or not a terminal voltage of a second terminal of the light-emitting element is to be boosted based on the light emission mode change information and an output of the detecting and comparing unit, and a voltage boosting circuit section which boosts the terminal voltage of the second terminal of the light-emitting element when the voltage boost determining unit determines that the voltage is to be boosted, and which does not boost the terminal voltage of the second terminal of the light-emitting element when the voltage boost determining unit determines that the voltage is not to be boosted.

According to another aspect of the present invention, there is provided a light-emitting element driving circuit comprising a brightness setting unit which sets a video image brightness based on a video image information signal from a video image processing circuit section, outputs video image brightness setting information, and outputs video image brightness change information, a light-emitting element driving unit which drives a light-emitting element with a current of a current value corresponding to the video image brightness setting information from the brightness setting unit, a detecting and comparing unit which detects a terminal voltage of a first terminal of the light-emitting element and compares with a predetermined voltage, a voltage boost determining unit which determines whether or not a terminal voltage of a second terminal of the light-emitting element is to be boosted based on the video image brightness setting information and an output of the detecting and comparing unit, and a voltage boosting circuit section which boosts the terminal voltage of the second terminal of the light-emitting element when the voltage boost determining unit determines that the voltage is to be boosted, and which does not boost the terminal voltage of the second terminal of the light-emitting element when the voltage boost determining unit determines that the voltage is not to be boosted.

According to a light-emitting element driving circuit of various aspects of the present invention, the voltage is boosted or not boosted based on at least one of the luminosity change information and the brightness change information, and the output of the detecting and comparing unit. Because of this, the voltage boosting circuit can be efficiently operated.

According to a light-emitting element driving circuit of various aspects of the present invention, the voltage is boosted or not boosted based on the light mission mode change information and the output of the detecting and comparing unit. Because of this, the voltage boosting circuit can be efficiently operated.

According to a light-emitting element driving circuit of various aspects of the present invention, the voltage is boosted or not boosted based on video image brightness change information and the output of the detecting and comparing unit. Because of this, the voltage boosting circuit can be efficiently operated.

BRIEF DESCRIPTION OF THE DRAWINGS

A preferred embodiment of the present invention will be described in detail by reference to the drawings, wherein.

DESCRIPTION OF THE PREFERRED EMBODIMENT

Preferred embodiments of the present invention will now be described in detail with reference to the drawings. In this description, the specific shape, material, numerical value, direction, etc. are given merely for exemplary purposes for facilitating understanding of the present invention, and may be suitably changed according to the usage, objective, specification, etc.

Figure 1:
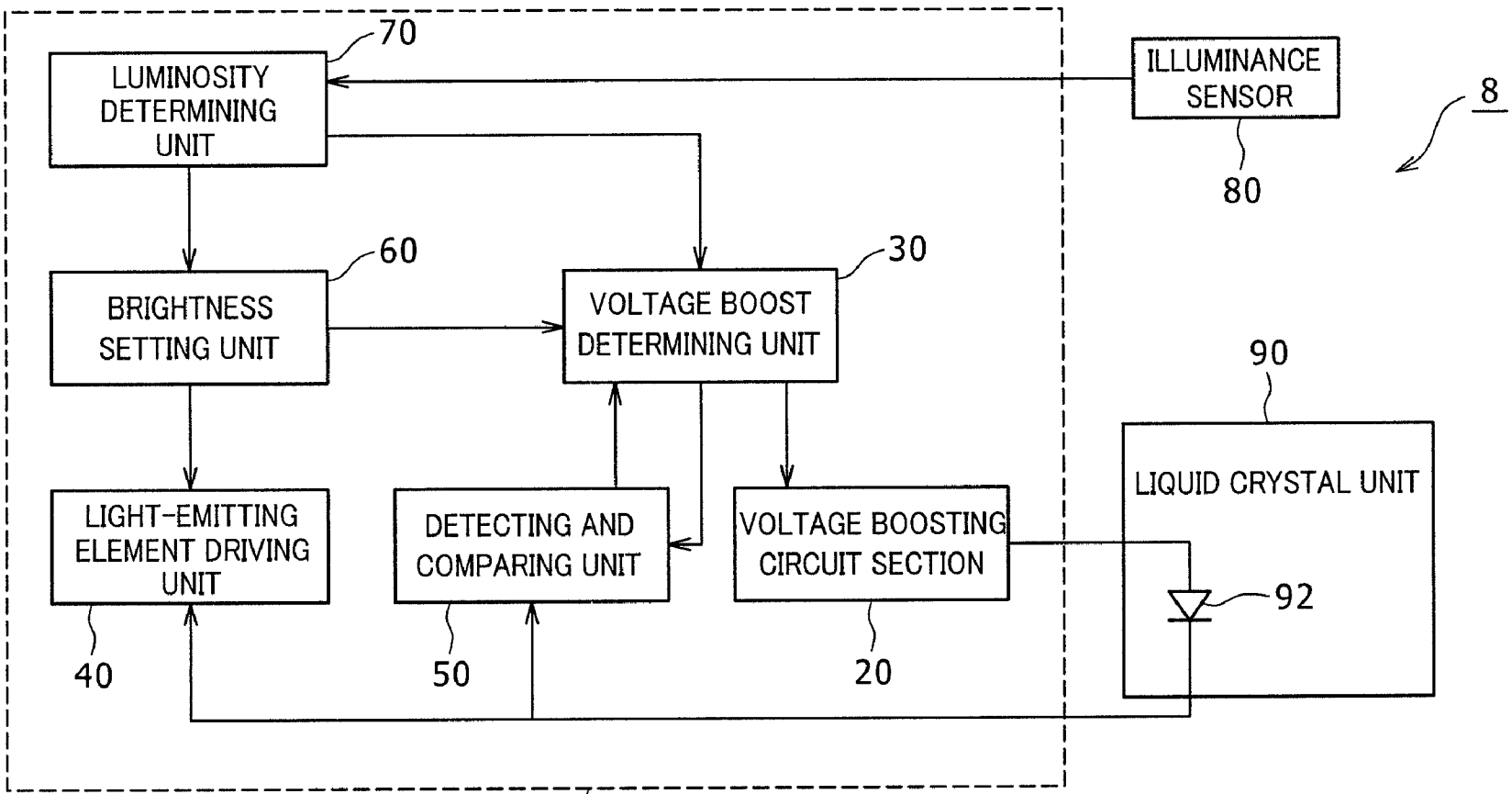
FIG. 1 is a diagram showing a liquid crystal backlight brightness changing system including a light-emitting element driving circuit according to a first preferred embodiment of the present invention.

FIG. 1 is a diagram showing a liquid crystal backlight brightness changing system 8 including a light-emitting element driving circuit 10 according to a first preferred embodiment of the present invention. The liquid crystal backlight brightness changing system 8 comprises a liquid crystal unit 90, a luminance sensor 80, and the light-emitting element driving circuit 10. The liquid crystal backlight brightness changing system 8 has a function to change the brightness of a backlight 92 of the liquid crystal unit 90 according to luminosity detected by a luminance sensor 80. The liquid crystal backlight brightness changing system 8 including the light-emitting element driving circuit 10 is equipped on a portable phone, but may alternatively be equipped on a terminal other than the portable phone having a liquid crystal unit 90.

The liquid crystal unit 90 is an image display device into which a liquid crystal element is incorporated. The liquid crystal unit 90 comprises the backlight 92 and a liquid crystal element and a polarization filter which are not shown. The liquid crystal unit 90 realizes a display by blocking or transmitting light which is emitted from a light source of the backlight 92.

The backlight 92 is a light-emitting element which emits light when a voltage is applied in a forward direction from a cathode terminal (cathode) to an anode terminal (anode). A forward voltage (Vf) of the backlight 92 is normally around 3.6 V, but the forward voltage (Vf) is changed due to process variation, current value, etc. In addition, the brightness can be changed by changing the current value of the current flowing in the backlight 92.

The luminance sensor 80 is a sensor which detects luminosity of the ambient environment or the like. More specifically, the luminance sensor 80 comprises a photodiode through which a reverse current which is proportional to luminance flows when light is irradiated and a current-voltage conversion circuit which converts current to voltage, and can measure luminance.

Figure 2:
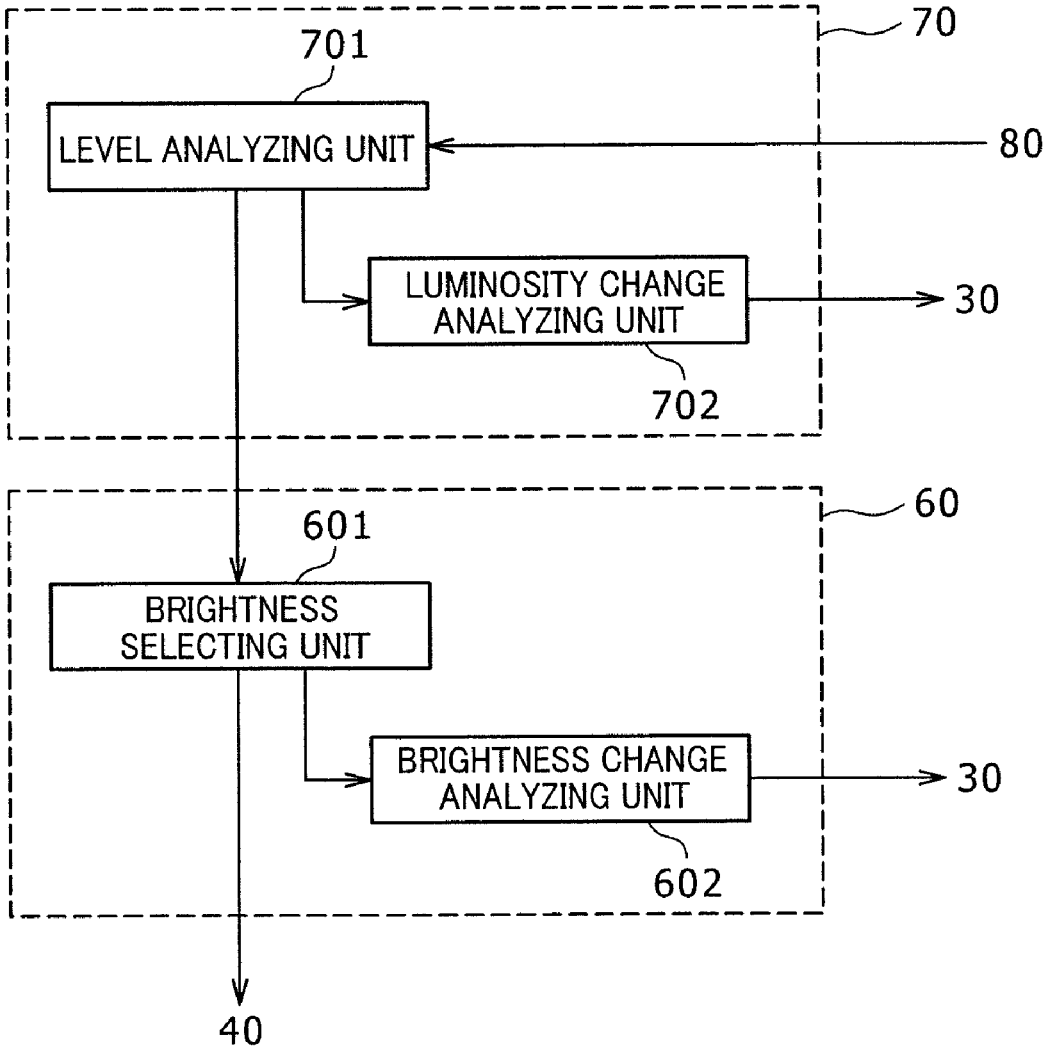
FIG. 2 is a block diagram showing a luminosity determining unit and a brightness setting unit of a light-emitting element driving circuit according to a first preferred embodiment of the present invention.

The light-emitting element driving circuit 10 comprises a luminosity determining unit 70, a brightness setting unit 60, a light-emitting element driving unit 40, a voltage boost determining unit 30, a detecting and comparing unit 50, and a voltage boosting circuit section 20. FIG. 2 is a block diagram of the luminosity determining unit 70 and the brightness setting unit 60. The luminosity determining unit 70 comprises a level analyzing unit 701 and a luminosity change analyzing unit 702. The level analyzing unit 701 has a function to receive, as an input, luminance information (in lux) from the luminance sensor 80 at a predetermined timing, classify the luminosity in 16 levels, and output luminosity level determination information to the brightness setting unit 60 to be described later.

The luminosity change analyzing unit 702 has a function to store the luminosity level determination information which is classified into 16 levels by the level analyzing unit 701, determine a change between the previous luminosity level determination information and the current luminosity level determination information, and output luminosity change information to the voltage boost determining unit 30 to be described later. The luminosity change information is a digital signal which is normally set to 0 and is set to 1 when it is detected that the luminosity has changed from a bright state to a dark state.

The brightness setting unit 60 comprises a brightness selecting unit 601 and a brightness change analyzing unit 602. The brightness selecting unit 601 has a function to receive, as an input, the luminosity level determination information from the luminosity determining unit 70, select brightness corresponding to the luminosity level determination information, and output a voltage corresponding to the selected brightness as brightness setting information to the light-emitting element driving unit 40.

The brightness change analyzing unit 602 has a function to store the brightness information selected by the brightness selecting unit 601, determine a change between the previous brightness information and the current brightness information, and output brightness change information to the voltage boost determining unit 30 to be described later. Here, the brightness change information is a digital signal which is normally set to 0 and set to 1 when it is detected that the state has changed from a state with high brightness to a state with low brightness.

Figure 3:
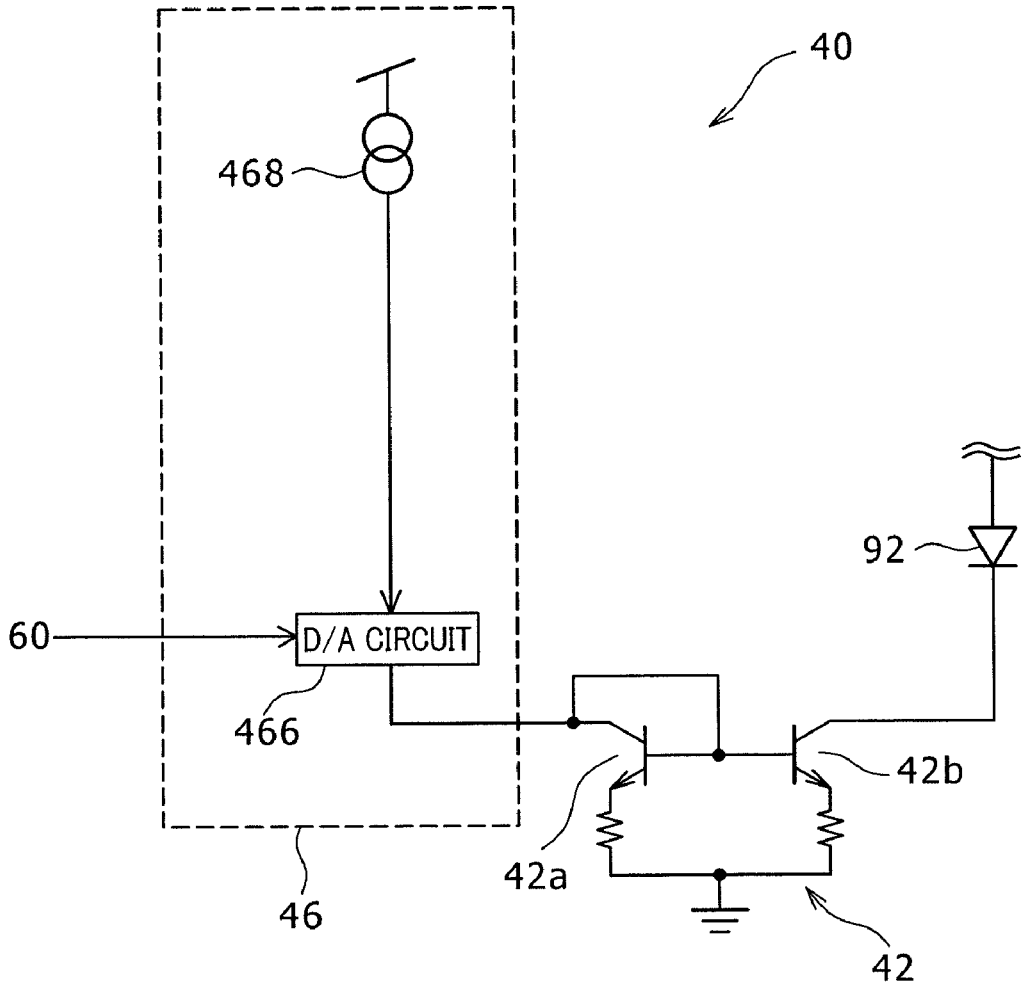
FIG. 3 is a diagram showing elements of a light-emitting element driving unit of a light-emitting element driving circuit according to a first preferred embodiment of the present invention.

FIG. 3 is a diagram showing elements of the light-emitting element driving unit 40. The light-emitting element driving unit 40 is a driving circuit comprising a current circuit section 42 and a current value setting circuit section 46. The light-emitting element driving unit 40 has a function to apply control such that a current flowing in the light-emitting element is a predetermined target value according to the brightness which is set by the brightness setting unit 60.

The current circuit section 42 is a current mirror circuit which supplies a current of a current value which is set by the current value setting circuit section 46 to be described later to the backlight 92. A current which is identical to a current flowing in a left-side transistor 42*a* flows in a right-side transistor 42*b*. The current circuit section 42 has a first terminal electrically connected to a cathode terminal of the backlight 92 and a second terminal electrically connected to the current value setting circuit section 46.

The current value setting circuit section 46 has a function to determine a current value based on the voltage which is output by the brightness setting unit 60 and to set the current value to the current circuit section 42. The current value setting circuit section 46 comprises a D/A circuit 466 and a reference current source 468.

The reference current source 468 is a current source for supplying a current of a predetermined current value. The reference current source 468 has a first terminal connected to a voltage source for supplying a predetermined voltage and a second terminal electrically connected to the D/A circuit. The D/A circuit 466 is a circuit for converting a digital signal into an analog signal. The D/A circuit 466 receives, as an input, a current of a reference current value which is supplied by the reference current source 468 and a voltage which is output by the brightness setting unit 60, converts the signals into analog signals, and outputs the analog signal to the current circuit section 42.

Figure 4:
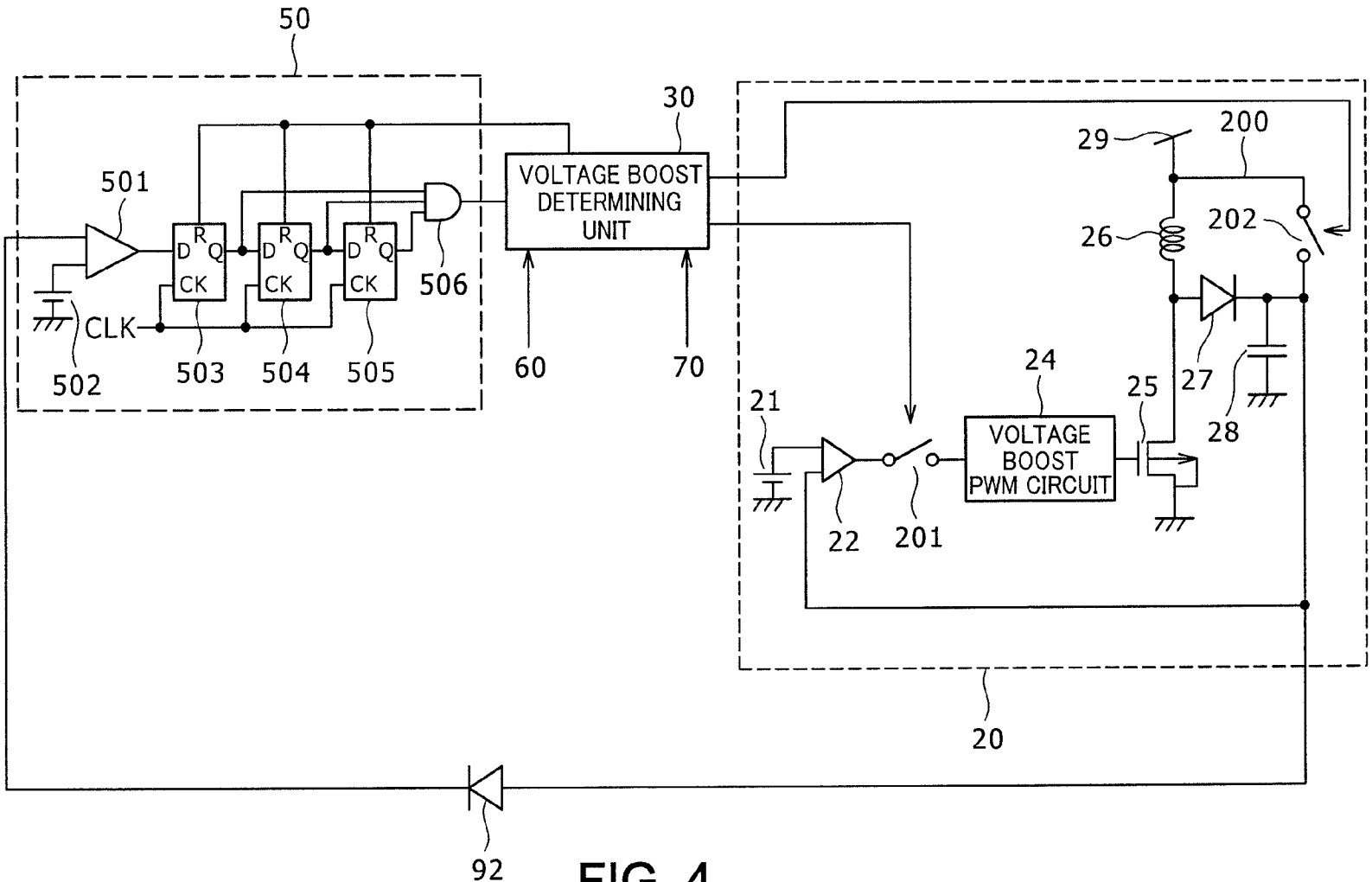
FIG. 4 is a diagram showing elements or the like of a detecting and comparing unit, a voltage boost determining unit, and a voltage boosting circuit section of a light-emitting element driving circuit according to a first preferred embodiment of the present invention.

FIG. 4 is a diagram showing elements or the like of the detecting and comparing unit 50, the voltage boost determining unit 30, and the voltage boosting circuit section 20. The detecting and comparing unit 50 has a function to detect a terminal voltage of the cathode terminal of the backlight 92 and compare with a predetermined voltage. The detecting and comparing unit 50 comprises a comparator 501, a first flip-flop 503, a second flip-flop 504, a third flip-flop 505, and an AND circuit 506.

The comparator 501 is a circuit which compares magnitude of two input voltages. A reference voltage which is input to an input terminal on a first side of the comparator 501 is supplied, for example, by a reference power supply 502 having a potential of 0.2 V. An input terminal on a second side of the comparator 501 is connected to the cathode terminal of the backlight 92. The comparator 501 compares the terminal voltage of the cathode terminal of the backlight 92 and the reference voltage. The comparator 501 outputs 1 when the terminal voltage of the cathode terminal of the backlight 92 is lower than the reference voltage and outputs 0 when the terminal voltage of the cathode terminal of the backlight 92 is higher than the reference voltage.

The first flip-flop 503 operates at a CLK (clock) of a predetermined frequency and receives the output of the comparator 501 as an input. An output of the first flip-flop 503 is connected to an input of the second flip-flop 504 and to an input of the AND circuit 506.

The second flip-flop 504 operates at a CLK (clock) of a predetermined frequency, and receives the output of the first flip-flop 503 as an input. An output of the second flip-flop 504 is connected to an input of the third flip-flop 505 and to an input of the AND circuit 50.

The third flip-flop 505 operates at a CLK (clock) of a predetermined frequency and receives the output of the second flip-flop 504 as an input. An output of the third flip-flop 505 is connected to an input of the AND circuit 506. Reset terminals of the first flip-flop 503, second flip-flop 504, and third flip-flop 505 are controlled by the voltage boost determining unit 30.

The AND circuit 506 is a logical multiplication circuit, and outputs 1 when all of the outputs of the first flip-flop 503, second flip-flop 504, and third flip-flop 505 are 1 and outputs 0 in all other cases.

The voltage boost determining unit 30 applies control to switch a switch 201 of the voltage boosting circuit section 20 ON and to switch a switch 202 of the voltage boosting circuit section 20 OFF when the output of the AND circuit 506 is 1. The voltage boost determining unit 30 also applies control to switch the switch 201 of the voltage boosting circuit section 20 OFF and to switch the switch 202 of the voltage boosting circuit section 20 ON when the output of the AND circuit 506 is 0. The voltage boost determining unit 30 has a function to send a reset signal to the reset terminals of the first flip-flop 503, second flip-flop 504, third flip-flop 505 to reset the first flip-flop 503, second flip-flop 504, and third flip-flop 505 when one of a signal of the luminosity change information from the luminosity determining unit 70 and a signal of the brightness change information from the brightness setting unit 60 is 1.

The voltage boosting circuit section 20 comprises a voltage boost comparator 22, a voltage boost PWM circuit 24, a voltage boost transistor 25, a voltage boost coil 26, a voltage boost diode 27, a voltage boost capacitor 28, and a voltage boost power supply 29, and is formed as a voltage boosting circuit.

The voltage boost comparator 22 is a circuit which compares the size of two input voltages, amplifies the difference between the input voltages, and outputs the amplified difference. A reference voltage which is input to an input terminal of a first side of the voltage boost comparator 22 is supplied, for example, by a reference power supply 21 having a potential of 4.2 V. An input terminal on a second side of the voltage boost comparator 22 is connected to the anode terminal of the backlight 92. The voltage boost comparator 22 compares the terminal voltage of the anode terminal of the backlight 92 and the reference voltage. An output of the voltage boost comparator 22 is input to the voltage boost PWM circuit 24.

The switch 201 is provided between the voltage boost comparator 22 and the voltage boost PWM circuit 24. When the switch 201 is in the ON state, the voltage boost comparator 22 and the voltage boost PWM circuit 24 are electrically connected, and when the switch 201 is in the OFF state, the voltage boost comparator 22 and the voltage boost PWM circuit 24 are not electrically connected. The switch 201 is controlled by the voltage boost determining unit 30. The switch 202 will be described later.

The voltage boost PWM circuit 24 is a circuit which modulates the input signal by changing a duty ratio of a pulse wave, which is one method of modulation. More specifically, the voltage boost PWM circuit 24 receives a comparison result by the voltage boost comparator 22 as an input, and changes the duty ratio of the pulse wave based on the comparison result. The voltage boost PWM circuit 24 has a function to control switching of the voltage boost transistor 25 with the pulse wave based on the comparison result.

The voltage boost transistor 25 is a MOS transistor which controls current between source and drain terminals through a principle of applying a voltage on a gate terminal and providing a barrier (gate) in the flow of the electrons or holes by an electric field of the channel. Switching of the voltage boost transistor 25 is controlled by a pulse wave which is output from the voltage boost PWM circuit 24 being applied on the gate terminal. The voltage boost transistor 25 has the gate terminal electrically connected to the output of the voltage boost PWM circuit 24, a drain terminal connected to the voltage boost coil 26 and an anode terminal of the voltage boost diode 27, and a source grounded.

The voltage boost coil 26 has a first end connected to the voltage boost power supply 29 and a second end connected to the drain terminal of the voltage boost transistor 25 and the anode terminal of the voltage boost diode 27. The voltage boost coil 26 is set to a state where a voltage from the voltage boost power supply 29 is applied when the voltage boost transistor 25 is set to the ON state and energy is accumulated.

The voltage boost diode 27 is a circuit having a rectifying function (a function to flow current only in a certain direction). With the voltage boost diode 27, a current flows from the voltage boost coil 26 in which energy is accumulated through the voltage boost diode 27 to the load, when the voltage boost transistor 25 is set to the OFF state. The voltage boost diode 27 has the anode terminal electrically connected to the voltage boost coil 26 and the voltage boost transistor 25.

The voltage boost capacitor 28 is a circuit element which accumulates or discharges charges (electrical energy) with an electrostatic capacitance. The voltage boost capacitor 28 has a function to accumulate charges flowing from the voltage boost coil 26 when the voltage boost transistor 25 is set to the OFF state. The voltage boost capacitor 28 has the first terminal electrically connected to the cathode terminal of the voltage boost diode 27 and the anode terminal of the backlight 92 and a second terminal grounded.

The switch 202 is provided on a through signal line 200 between the voltage boost power supply 29 and the anode terminal of the backlight 92. When the switch 202 is in the ON state, the voltage boost power supply 29 and the anode terminal of the backlight 92 are electrically connected, and when the switch 202 is in the OFF state, the voltage boost power supply 29 and the anode terminal of the backlight 92 are not electrically connected. The switch 202 is controlled by the voltage boost determining unit 30.

Next, the operation of the light-emitting element driving circuit 10 having the above-described structure will be described with reference to FIGS. 1-4. When the terminal voltage of the cathode terminal of the backlight 92 becomes less than or equal to the reference voltage supplied from the reference power supply 502, the output of the comparator 501 becomes 1. Then, at the next rising edge of the CLK (clock), 1 which is the value of the output of the comparator 501 is read into the first flip-flop 503 as an input, and the first flip-flop 503 outputs 1. Then, at the next rising edge of the CLK (clock), 1 which is the value of the output of the first flip-flop 503 is read into the second flip-flop 504 as an input, and the second flip-flop 504 outputs 1. At the next rising edge of the CLK (clock), 1 which is the value of the output of the second flip-flop 504 is read into the third flip-flop 505 as an input, and the third flip-flop 505 outputs 1. The AND circuit 506 outputs 1 indicating that the voltage of the anode terminal of the backlight 92 must be boosted when all of the outputs of the first flip-flop 503, second flip-flop 504, and third flip-flop 505 are 1.

The voltage boost determining unit 30 switches the switch 201 of the voltage boosting circuit section 20 ON and switches the switch 202 of the voltage boosting circuit section 20 OFF when the output of the AND circuit 506 is 1. In this process, the voltage boost comparator 22 of the voltage boosting circuit section 20 compares the terminal voltage of the anode terminal of the backlight 92 and the reference voltage which is supplied from the reference power supply 21 and outputs the difference. The voltage boost PWM circuit 24 generates a voltage boost PWM signal which is a PWM signal for voltage boost corresponding to the output of the voltage boost comparator 22.

The voltage boost transistor 25 is controlled to be switched ON and OFF according to the voltage boost PWM signal, and when the voltage boost transistor 25 is in the ON state, energy is accumulated in the voltage boost coil 26. Then, when the voltage boost transistor 25 is set to the OFF state, the energy accumulated in the voltage boost coil 26 is charged to the voltage boost capacitor 28 through the voltage boost diode 27, and the terminal voltage of the anode side of the backlight 92 can be boosted.

In the above-description, the voltage boosting circuit section 20 is described as comprising the voltage boost comparator 22, voltage boost PWM circuit 24, voltage boost transistor 25, voltage boost coil 26, voltage boost diode 27, voltage boost capacitor 28, and voltage boost power supply 29, but alternatively, the voltage boosting circuit section 20 may be another circuit having a voltage boosting function, such as, for example, a charge pump circuit.

When the luminosity detected by the luminance sensor 80 changes from a bright state to a dark state, the luminosity determining unit 70 outputs 1 as the signal of the luminosity change information, indicating that the luminosity has changed from the bright state to the dark state. In addition, the brightness setting unit 60 outputs 1 as the signal of the brightness change information, indicating that the brightness has changed from a high brightness state to a dark state. During this process, the brightness which is set by the brightness setting unit 60 is a low value. Because of this, the current value of the current in the backlight 92 which is set by the light-emitting element driving unit 40 is at a low value. With this process, there may be cases where the forward voltage (Vf) of the backlight 92 is reduced, the cathode voltage is increased, and it is no longer necessary to boost the voltage. When the luminosity of the ambient environment changes from the bright state to the dark state, there may be cases where 1 is output as one of the signal of the luminosity change information and the signal of the brightness change information.

With regard to the voltage boost determining unit 30, a signal is sent to the reset terminals of the first flip-flop 503, second flip-flop 504, and third flip-flop 505 to reset the flip-flops when at least one of the signal of the luminosity change information from the luminosity determining unit 70 and the signal of the brightness change information from the brightness setting unit 60 is 1. Thus, the output of the AND circuit 506 becomes 0.

When the output of the AND circuit 506 is 0, the voltage boost determining unit 30 switches the switch 201 of the voltage boosting circuit section 20 OFF and switches the switch 202 of the voltage boosting circuit section 20 ON. In this process, although the voltage boost power supply 29 and the anode terminal of the backlight 92 are directly connected, because the switch 201 is in the OFF state, the operation of the voltage boosting circuit is stopped. In this manner, by stopping the operation of the voltage boosting circuit when it is not necessary to boost the voltage, according to the luminosity change information and the brightness change information, it is possible to prevent increase in the wasteful current consumption. After the first flip-flop 503, second flip-flop 504, and third flip-flop 505 are reset by the reset terminals, it is again searched whether or not the voltage is to be boosted based on the output result from the comparator 501.

Figure 5:
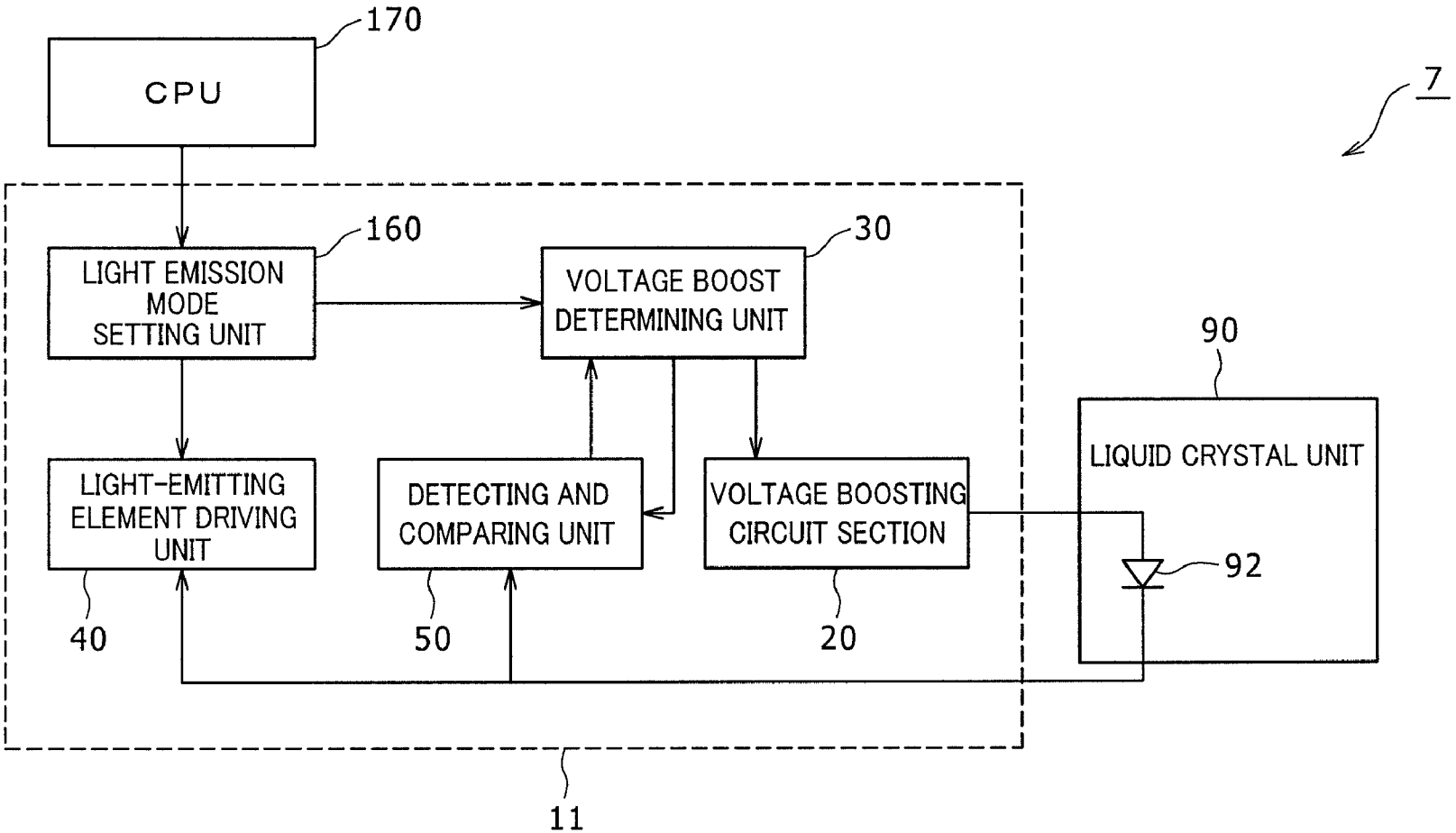
FIG. 5 is a diagram showing a liquid crystal backlight brightness changing system including a light-emitting element driving circuit according to a second preferred embodiment of the present invention.

Next, a liquid crystal backlight brightness changing system 7 including a light-emitting element driving circuit 11 according to a second preferred embodiment of the present invention will be described. FIG. 5 is a diagram showing the liquid crystal backlight brightness changing system including the light-emitting element driving circuit 11 according to the second preferred embodiment of the present invention. Here, as the light-emitting element driving circuit 11 has approximately the same structure as the light-emitting element driving circuit 10 of the above-described first preferred embodiment, the same reference numerals are assigned to the same constituting elements, and repeated description will not be given. The structure and operation of the differing structures will be primarily described.

The liquid crystal backlight brightness changing system 7 comprises the liquid crystal unit 90, a CPU (central processing unit) 170, and the light-emitting element driving circuit 11. The liquid crystal backlight brightness changing system 7 has a function to change the brightness of the backlight 92 of the liquid crystal unit 90 according to a light emission mode.

The CPU 170 is a microcomputer which controls the overall functions of the portable phone. The CPU 170 has a function, for example, to transmit a normal mode (a strong light emission mode of the backlight 92) signal indicating that the backlight 92 is high brightness to a light emission mode setting unit 160 when the key button or the like of the portable phone is operated, and after a state where no operation is applied is continued for a predetermined time period, to transmit a slight emission mode (weak light emission mode of the backlight 92) signal indicating low brightness to the light emission mode setting unit 160.

Figure 6:
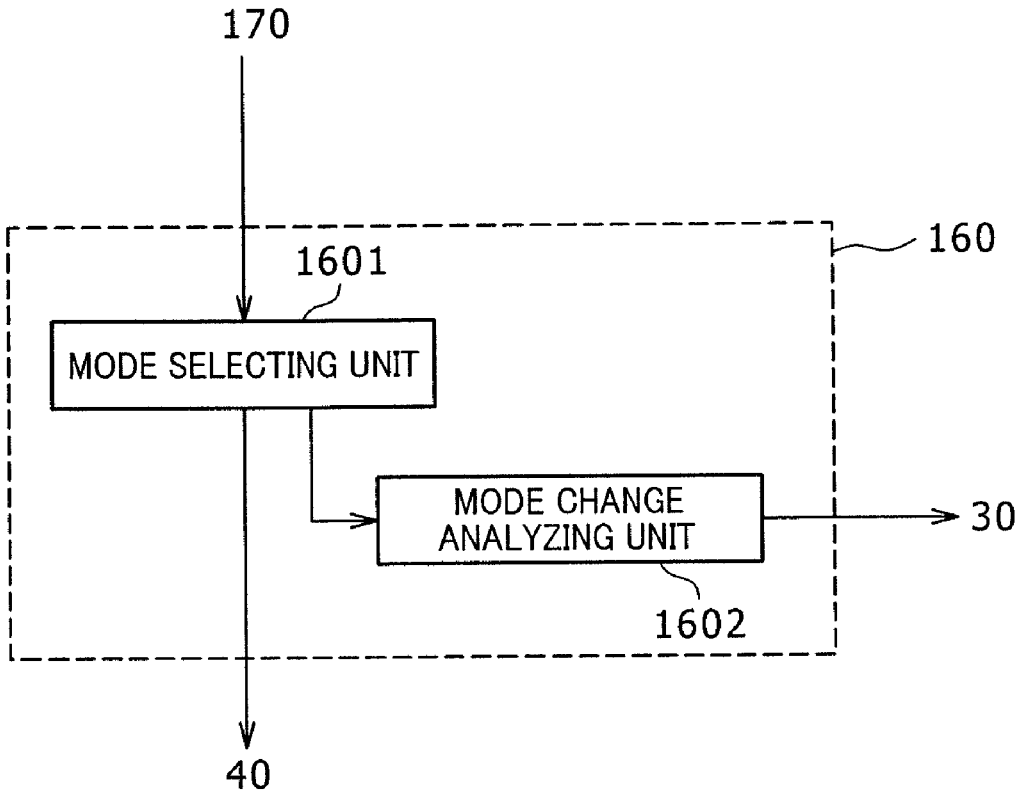
FIG. 6 is a block diagram showing a luminosity determining unit and a brightness setting unit of a light-emitting element driving circuit according to a second preferred embodiment of the present invention.

The light-emitting element driving circuit 11 comprises the light emission mode setting unit 160, the light-emitting element driving unit 40, the voltage boost determining unit 30, the detecting and comparing unit 50, and the voltage boosting circuit section 20. FIG. 6 is a block diagram of the light emission mode setting unit 160. The light emission mode setting unit 160 comprises a mode selecting unit 1601 and a mode change analyzing unit 1602. The mode selecting unit 1601 has a function to receive an input of a light emission mode signal from the CPU 170, select a brightness corresponding to the strong light emission mode or the weak light emission mode, and output a voltage corresponding to the selected brightness to the light-emitting element driving unit 40 as light emission mode setting information.

The mode change analyzing unit 1602 has a function to store a light emission mode received by the mode selecting unit 1601, determine a change between the previous light emission mode and the current light emission mode, and output light emission mode change information to the voltage boost determining unit 30 to be described later. Here, the light emission mode change information is a digital signal which is normally set to 0 and which is set to 1 when it is detected that the previous light emission mode is the strong light emission mode and the current light emission mode is changed to the weak light emission mode.

Figure 7:
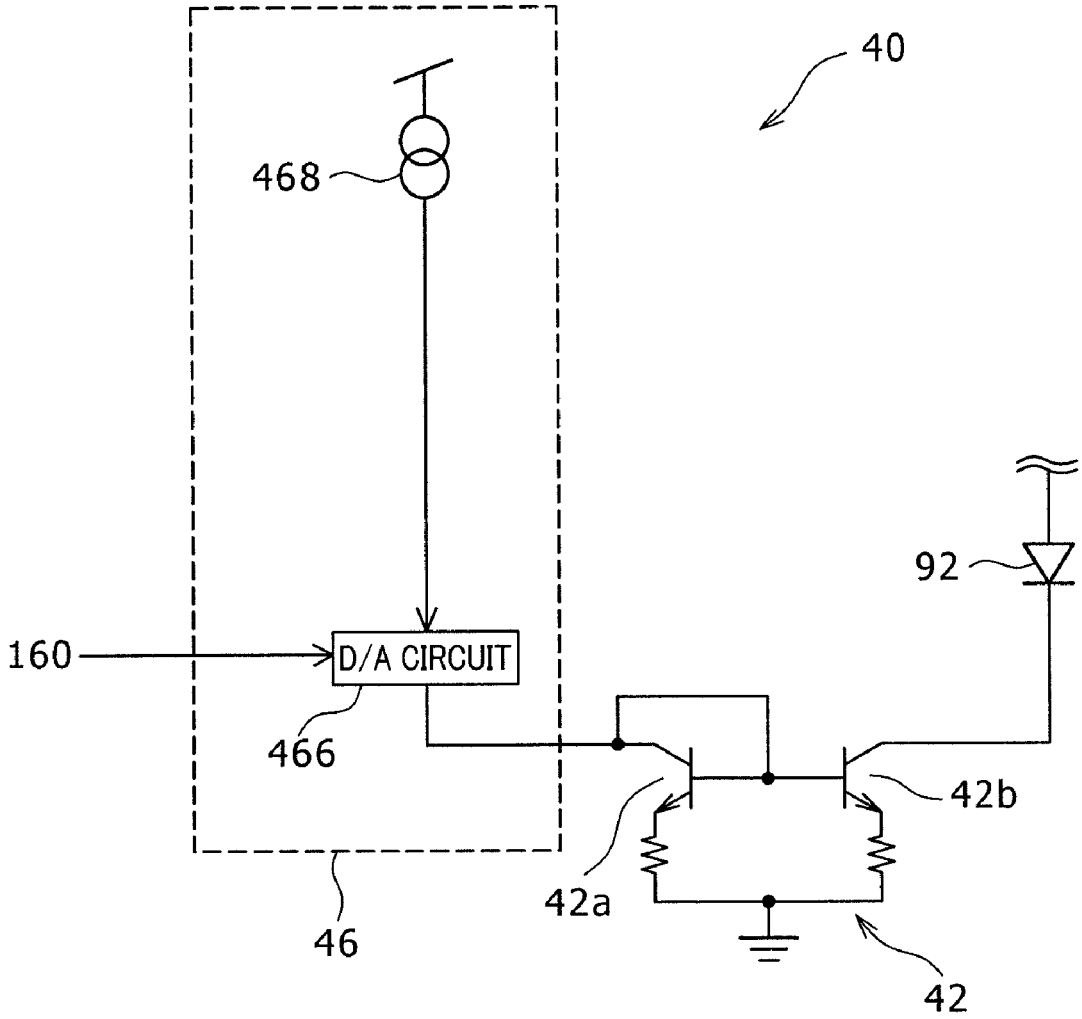
FIG. 7 is a diagram showing elements of a light-emitting element driving unit of a light-emitting element driving circuit according to a second preferred embodiment of the present invention.

FIG. 7 is a diagram showing elements of the light-emitting element driving unit 40. The light-emitting element driving unit 40 is a driving circuit comprising the current circuit section 42 and the current value setting circuit section 46. The light-emitting element driving unit 40 has a function to control the current flowing in the light-emitting element to a predetermined target value according to the brightness which is set by the light emission mode setting unit 160

The current value setting circuit section 46 has a function to determine a current value based on the voltage which is output by the light emission mode setting unit 160 and set the current value to the current circuit section 42. The current value setting circuit 46 comprises a D/A circuit 466 and a reference current source 468.

The reference current source 468 is a current source for supplying a current of a predetermined current value. The reference current source 468 has a first terminal connected to a voltage source which supplies a predetermined voltage, and a second terminal electrically connected to the D/A circuit. The D/A circuit 466 is a circuit which converts a digital signal into an analog signal. The D/A circuit 466 receives, as an input, a current of the reference current value supplied by the reference current source 468 and the voltage which is output by the light emission mode setting unit 160, converts the input signal into an analog signal, and outputs the analog signal to the current circuit section 42.

Figure 8:
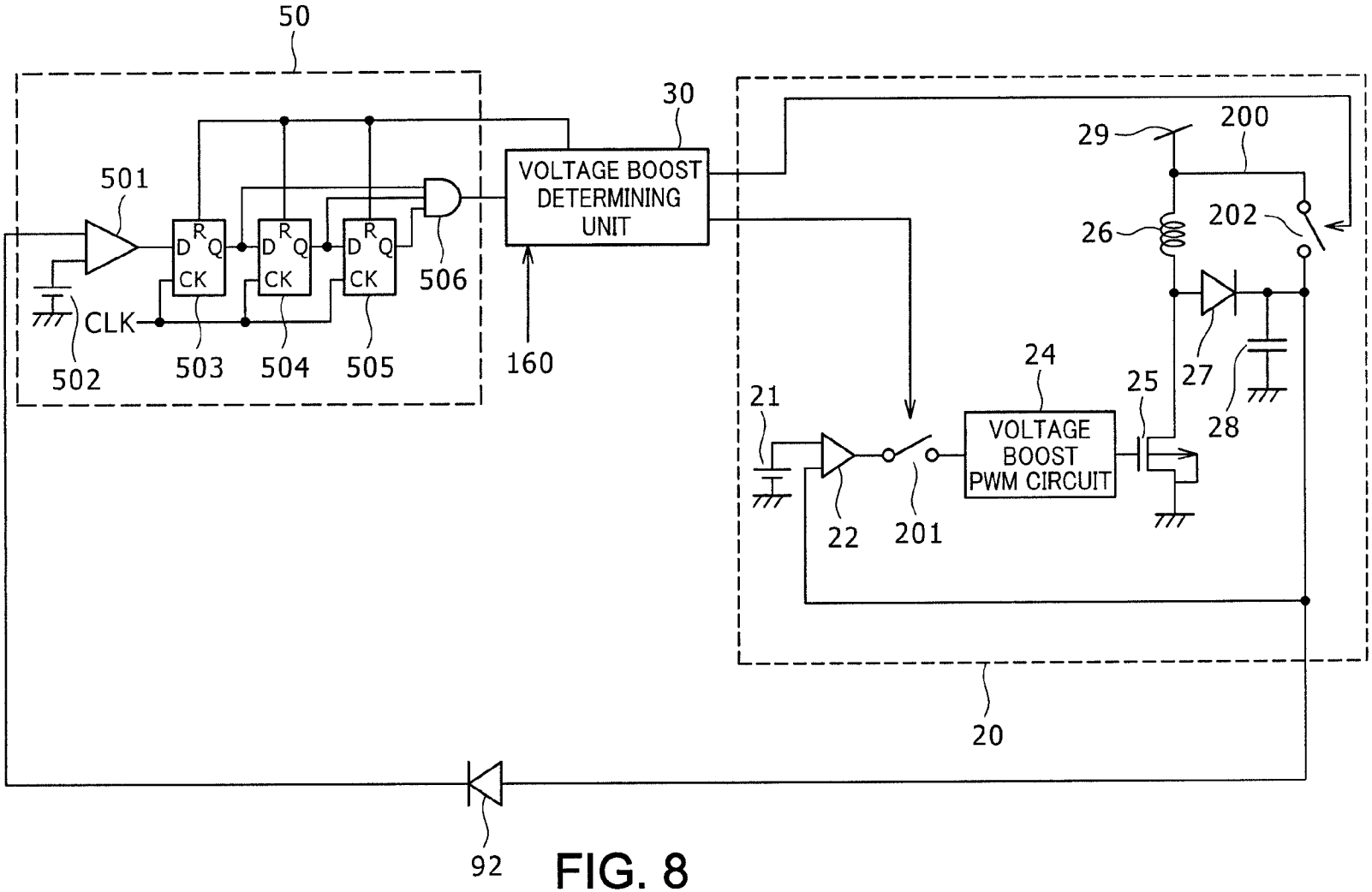
FIG. 8 is a diagram showing elements or the like of a detecting and comparing unit, a voltage boost determining unit, and a voltage boosting circuit section of a light-emitting element driving circuit according to a second preferred embodiment of the present invention.

FIG. 8 is a diagram showing elements or the like of the detecting and comparing unit 50, voltage boost determining unit 30, and voltage boosting circuit section 20. The voltage boost determining unit 30 switches the switch 201 of the voltage boosting circuit section 20 ON and switches the switch 202 of the voltage boosting circuit section 20 OFF when the output of the AND circuit 506 is 1. The voltage boost determining unit 30 also switches the switch 201 of the voltage boosting circuit section 20 OFF and switches the switch 202 of the voltage boosting circuit section 20 ON when the output of the AND circuit 506 is 0. The voltage boost determining unit 30 has a function to send a reset signal to the reset terminals of the first flip-flop 503, second flip-flop 504, and third flip-flop 505 to reset the flip-flops when the signal of the light emission mode change information from the light emission mode setting unit 160 is 1.

Next, the operation of the light-emitting element driving circuit 11 having the above-described structure will be described with reference to FIGS. 5-8. When the terminal voltage of the cathode terminal of the backlight 92 becomes less than or equal to the reference voltage which is supplied from the reference power supply 502, the output of the comparator 501 becomes 1, and the terminal voltage of the anode side of the backlight 92 can be boosted in a manner similar to the light-emitting element driving circuit 10 described above.

When the signal of the light emission mode from the CPU 170 changes from the strong light emission mode to the weak light emission mode, the light emission mode setting unit 160 outputs 1 as the signal of the light emission mode change information indicating that the light emission mode has changed from the strong light emission mode to the weak light emission mode. In this process, the brightness which is set by the light emission mode setting unit 160 is set to a low value, and thus the current value of the backlight 92 which is set by the light-emitting element driving unit 40 is a low value. Because of this, there may be case where the forward voltage (Vf) of the backlight 92 is reduced, the cathode voltage is increased, and the voltage boosting becomes no longer necessary.

With regard to the voltage boost determining unit 30, when the signal of the light emission mode change information from the light emission mode setting unit 160 is 1, a signal is sent to the reset terminals of the first flip-flop 503, second flip-flop 504, and third flip-flop 505 to reset the flip-flops, and the output of the AND circuit 506 becomes 0.

The voltage boost determining unit 30 switches the switch 201 of the voltage boosting circuit section 20 OFF and switches the switch 202 of the voltage boosting circuit section 20 ON when the output of the AND circuit 506 is 0. In this process, although the voltage boost power supply 29 and the anode terminal of the backlight 92 are directly connected, because the switch 201 is in the OFF state, the operation of the voltage boosting circuit is stopped. In this manner, by stopping the operation of the voltage boosting circuit when it is not necessary to boost the voltage according to the light emission mode change information, it is possible to prevent increase of wasteful current consumption.

Figure 9:
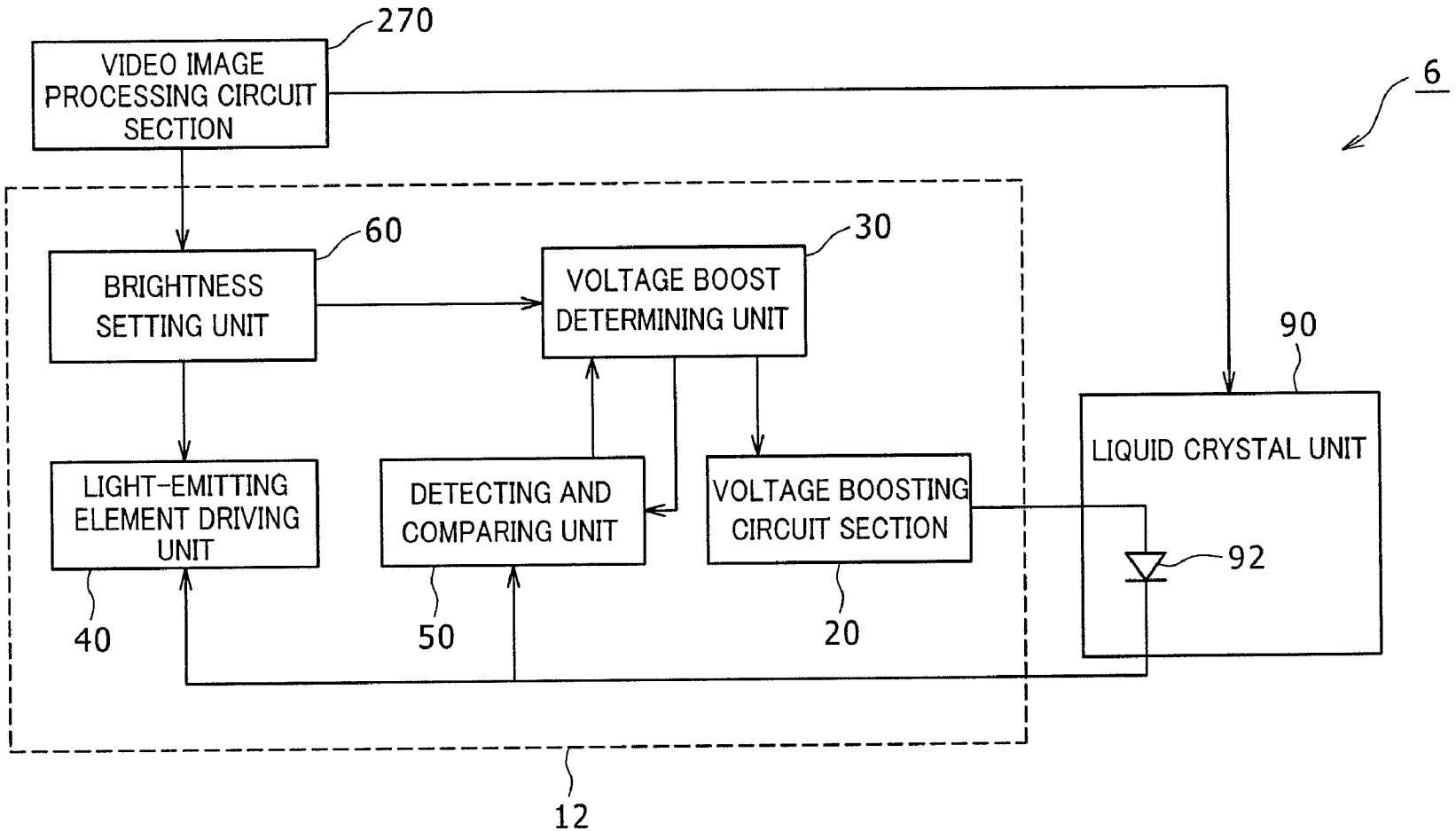
FIG. 9 is a diagram showing a liquid crystal backlight brightness changing system including a light-emitting element driving circuit according to a third preferred embodiment of the present invention.

Next, a liquid crystal backlight brightness changing system 6 having a light-emitting element driving circuit 12 according to a third preferred embodiment of the present invention will be described. FIG. 9 is a diagram showing the liquid crystal backlight brightness changing system 6 including the light-emitting element driving circuit 12 of the third preferred embodiment of the present invention. Here, as the light-emitting element driving circuit 12 has a structure which is approximately the same as that of the light-emitting element driving circuit 10 of the first preferred embodiment described above, the same reference numerals are assigned to the same constituent elements, and repeated description will not be given. The structure and operation of the differing structures will primarily be described.

The liquid crystal backlight brightness changing system 6 comprises the liquid crystal unit 90, a video image processing circuit section 270, and the light-emitting element driving circuit 12. The liquid crystal backlight brightness changing system 6 has a function to change the brightness of the backlight 92 of the liquid crystal according to the video image signal.

The video image processing circuit section 270 has a function to output a signal obtained by processing a video image signal such as a broadcast signal to the liquid crystal unit 90. The video image processing circuit section 270 also has a function to generate a signal for adjusting the brightness according to content of the video image signal and output to the brightness setting unit 60.

Figure 10:
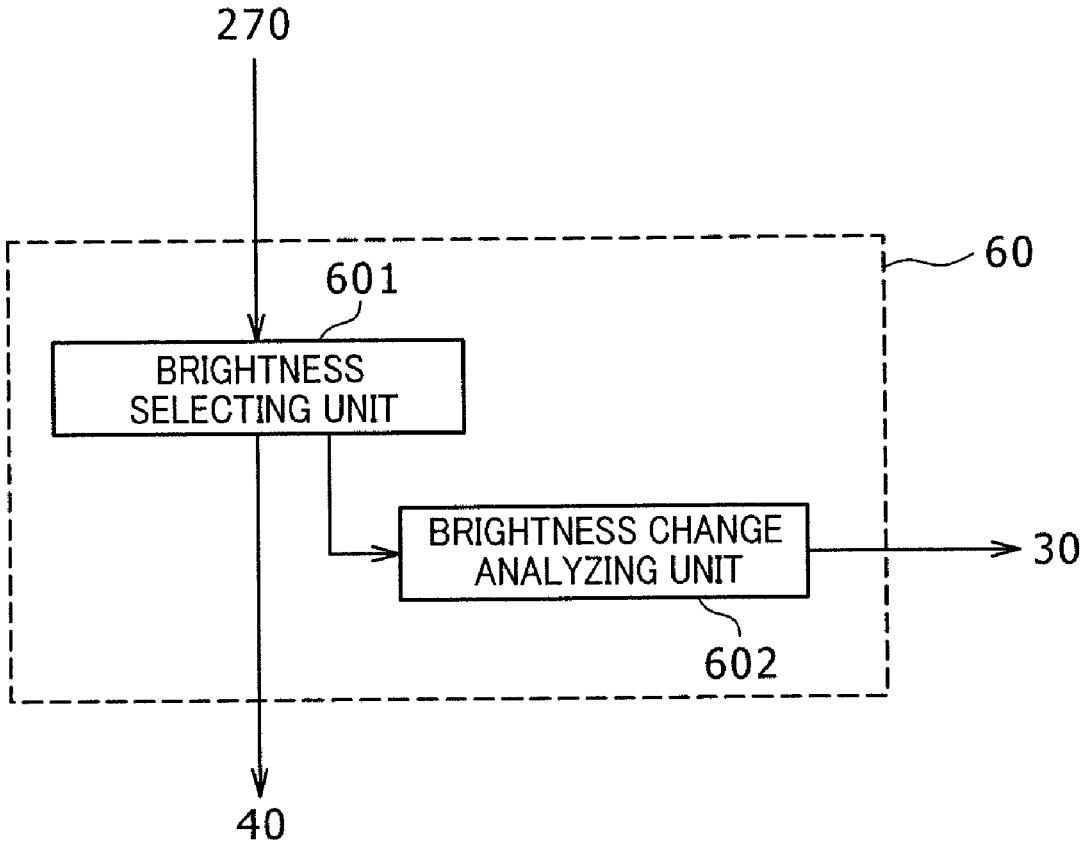
FIG. 10 is a block diagram of a luminosity determining unit and a brightness setting unit of a light-emitting element driving circuit according to a third preferred embodiment of the present invention.

The light-emitting element driving circuit 12 comprises the brightness setting unit 60, the light-emitting element driving unit 40, the voltage boost determining unit 30, the detecting and comparing unit 50, and the voltage boosting circuit section 20. FIG. 10 is a block diagram of the brightness setting unit 60. The brightness setting unit 60 comprises the brightness selecting section 601 and the brightness change analyzing section 602. The brightness selecting section 601 has a function to receive, as an input, a signal for adjusting brightness from the video image processing circuit section 270, select brightness corresponding to the signal for adjusting brightness, and output a voltage corresponding to the selected brightness to the light-emitting element driving unit 40 as video image brightness setting information.

The brightness change analyzing section 602 has a function to store brightness information selected by the brightness selecting section 601, determine a change between the previous brightness information and current brightness information, and output the video image brightness change information to the voltage boost determining unit 30 to be described later. The video image brightness change signal is a digital signal, and is normally set to 0 and set to 1 when it is detected that the state is changed from a high brightness state to a low brightness state.

Figure 11:
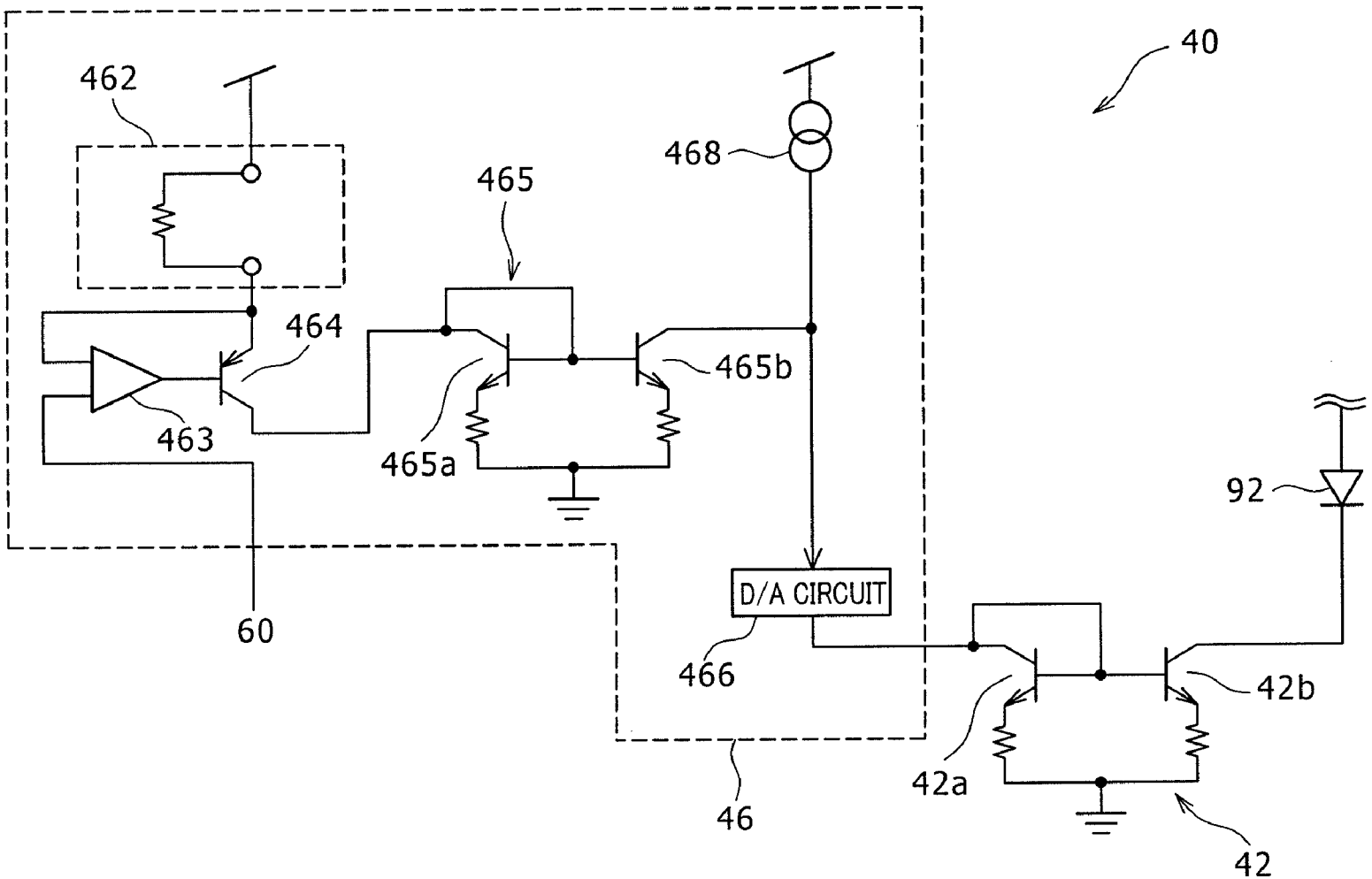
FIG. 11 is a diagram showing elements of a light-emitting element driving unit of a light-emitting element driving circuit according to a third preferred embodiment of the present invention.

FIG. 11 is a diagram showing elements of the light-emitting element driving unit 40. The light-emitting element driving unit 40 is a driving circuit comprising the current circuit section 42 and the current value setting circuit section 46. The light-emitting element driving unit 40 has a function to apply control such that the current flowing in the light-emitting element has a predetermined target value according to the brightness which is set by the brightness setting unit 60.

The current circuit section 42 is a current mirror circuit for supplying a current of the current value which is set by the current value setting circuit section 46, to be described later, to the backlight 92. In the current mirror circuit, a current which is equal to a current flowing through the left-side transistor 42*a* flows through the right-side transistor 42*b*. The current circuit section 42 has a first terminal electrically connected to the cathode terminal of the backlight 92 and a second terminal electrically connected to the current value setting circuit section 46.

The current value setting circuit section 46 has a function to determine a current value based on the voltage which is output by the brightness setting unit 60 and set the current value to the current circuit section 42. The current value setting circuit section 46 comprises a current value setting side resistor 462, a current value setting side comparator 463, a current value setting side transistor 464, a current value setting side current mirror circuit 465, a D/A circuit 466, and a reference current source 468.

The current value setting side resistor 462 is a circuit element which inhibits flow of current. A voltage source which supplies a predetermined voltage is connected on a first end side of the current value setting side resistor 462, and the current value setting side comparator 463 and the current value setting side transistor 464 are connected to a second end side of the current value setting side resistor 462. Here, a voltage which is obtained by dividing a predetermined voltage by the current value setting side resistor 462 is input to the current value setting side comparator 463 as a current value setting side reference voltage. The current value setting side resistor 462 may alternatively be provided as an external resistor element on a semiconductor substrate on which the light-emitting element driving circuit 12 is provided, and the resistance value may be changed as necessary, to change the current value of the current flowing in the current value setting side transistor 464.

The current value setting side comparator 463 compares the current value setting side reference voltage and the voltage which is output by the brightness setting unit 60, and outputs the difference. The output of the current value setting side comparator 463 is input to the current value setting side transistor 464.

The current value setting side transistor 464 has electrodes electrically connected to the current value setting side resistor 462, current value setting side current mirror circuit 465, and current value setting side comparator 463. A current corresponding to the output voltage of the current value setting side comparator 463 flows in the current value setting side transistor 464. In other words, a current corresponding to the video image brightness setting information flows. A bipolar transistor is used as the current value setting side transistor 464. Alternatively, it is also possible to use a MOS transistor.

In the current value setting side current mirror circuit 465, a current which is equal to a current flowing in the left-side transistor 465*a* flows in the right-side transistor 465*b*. In the current value setting side current mirror circuit 465, when the current value setting side transistor 464 goes to the ON state, a current having the same value as the current flowing in the left-side transistor 465*a* flows in the right-side transistor 465*b*.

The reference current source 468 is a current source which supplies a current of a predetermined current value. The reference current source 468 has a first terminal connected to a predetermined power supply voltage and a second terminal electrically connected to the D/A circuit 466 and a DC-side current mirror circuit 465.

The D/A circuit 466 is a circuit which converts a digital signal into an analog signal. The D/A circuit 466 receives an input of a current having a current value obtained by subtracting, using the current value setting side current mirror circuit 465, from the reference current value supplied by the reference current source 468, converts the input signal into an analog signal, and outputs the analog signal to the current circuit section 42.

Figure 12:
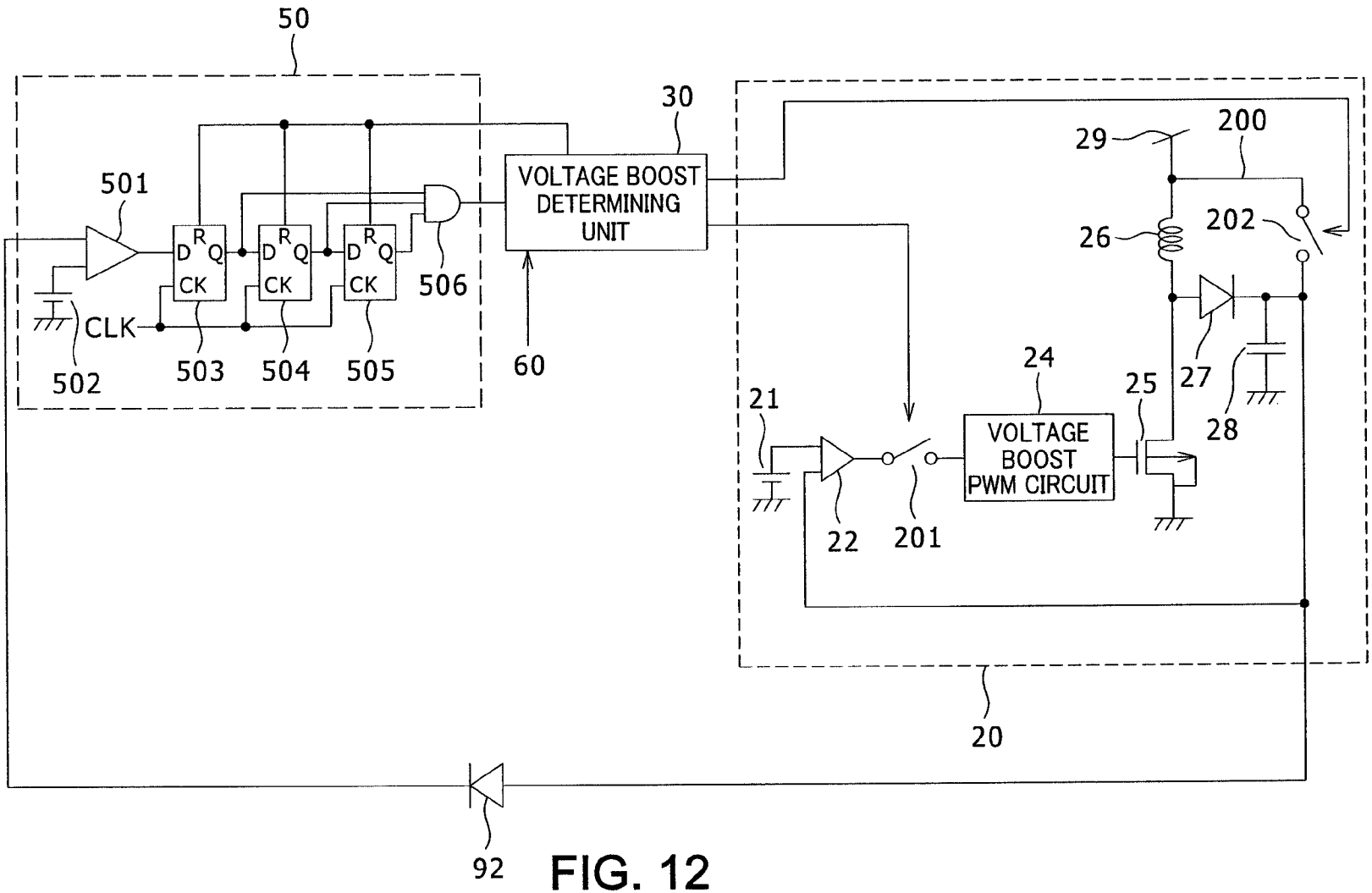
FIG. 12 is a diagram showing elements or the like of a detecting and comparing unit, a voltage boost determining unit, and a voltage boosting circuit section of a light-emitting element driving circuit according to a third preferred embodiment of the present invention.

FIG. 12 is a diagram showing elements or the like of the detecting and comparing unit 50, voltage boost determining unit 30, and voltage boosting circuit section 20. The voltage boost determining unit 30 switches the switch 201 of the voltage boosting circuit section 20 ON and switches the switch 202 of the voltage boosting circuit section 20 OFF when the output of the AND circuit 506 is 1. The voltage boost determining unit 30 switches the switch 201 of the voltage boosting circuit section 20 OFF and switches the switch 202 of the voltage boosting circuit section 20 ON when the output of the AND circuit 506 is 0. The voltage boost determining unit 30 has a function to send a reset signal to the reset terminals of the first flip-flop 503, second flip-flop 504, and third flip-flop 505 to reset the flip-flops when the signal of the video image brightness change information from the brightness setting unit 60 is 1.

Next, the operation of the light-emitting element driving circuit 12 having the above-described structure will be described with reference to FIGS. 9-12. When the terminal voltage of the cathode terminal of the backlight 92 becomes less than or equal to the reference voltage supplied from the reference power supply 502, the output of the comparator 501 becomes 1, and the anode side terminal voltage of the backlight 92 can be boosted in a similar manner to the light-emitting element driving circuit 10 described above.

When a signal for adjusting brightness corresponding to the content of the video image signal is received from the video image processing circuit section 270 and the state changes from a high brightness state to a low brightness state, the brightness setting unit 60 outputs 1 as the signal of the video image brightness change information. Here, because the brightness which is set by the brightness setting unit 60 has a low value, the current value of the backlight 92 which is set by the light-emitting element driving unit 40 has a low value. With this process, there may be cases where the forward voltage (Vf) of the backlight 92 is reduced, the cathode voltage is increased, and it becomes no longer necessary to boost the voltage.

With regard to the voltage boost determining unit 30, a signal is sent to the reset terminals of the first flip-flop 503, second flip-flop 504, and third flip-flop 505 to reset the flip-flops when the signal of the video image brightness change information from the brightness setting unit 60 is 1. Thus, the output of the AND circuit 506 becomes 0.

The voltage boost determining unit 30 switches the switch 201 of the voltage boosting circuit section 20 OFF and switches the switch 202 of the voltage boosting circuit section 20 ON when the output of the AND circuit 506 is 0. In this process, although the voltage boost power supply 29 and the anode terminal of the backlight 92 are directly connected, because the switch 201 is in the OFF state, the operation of the voltage boosting circuit is stopped. In this manner, by stopping the operation of the voltage boosting circuit when it is not necessary to boost the voltage according to the video image brightness change information, it is possible to prevent increase of wasteful current consumption.

What is claimed is:

1. A light-emitting element driving circuit comprising:

a luminosity determining unit which acquires luminance information from a luminance sensor, determines luminosity, outputs a luminosity determination result, and outputs luminosity change information;

a brightness setting unit which sets brightness based on the luminosity determination result of the luminosity determining unit, outputs brightness setting information, and outputs brightness change information;

a light-emitting element driving unit which drives a light-emitting element with a current of a current value corresponding to the brightness setting information from the brightness setting unit;

a detecting and comparing unit which detects a terminal voltage of a first terminal of the light-emitting element and compares with a predetermined voltage;

a voltage boost determining unit which determines whether or not a terminal voltage of a second terminal of the light-emitting element is to be boosted based on at least one of the luminosity change information and the brightness change information, and an output of the detecting and comparing unit; and a voltage boosting circuit section which boosts the terminal voltage of the second terminal of the light-emitting element when the voltage boost determining unit determines that the voltage is to be boosted and which does not boost the terminal voltage of the second terminal of the light-emitting element when the voltage boost determining unit determines that the voltage is not to be boosted.

2. The light-emitting element driving circuit according to claim 1, wherein the voltage boosting circuit section comprises:

a voltage boosting circuit which is driven by a power supply circuit and which boosts the terminal voltage of the second terminal of the light-emitting element;

a through connection signal line which enables connection of the power supply circuit and the second terminal of the light-emitting element; and a switching circuit which enables the voltage boosting circuit to function and does not connect the power supply circuit and the second terminal of the light-emitting element by the through connection signal line when the voltage boost determining unit determines that the voltage is to be boosted, and which connects the power supply circuit and the second terminal of the light-emitting element by the through connection signal line and does not enable the voltage boosting circuit to function when the voltage boost determining unit determines that the voltage is not to be boosted.

3. The light-emitting element driving circuit according to claim 2, wherein when the luminosity change information indicates that a state has changed from a bright state to a dark state, the voltage boost determining unit determines that the terminal voltage of the second terminal of the light-emitting element is not to be boosted, and the switching circuit connects the power supply circuit and the second terminal of the light-emitting element by the through connection signal line and does not enable the voltage boosting circuit to function, and then, based on the output of the detecting and comparing unit, it is determined whether or not the terminal voltage of the second terminal of the light-emitting element is to be boosted.

4. The light-emitting element driving circuit according to claim 2, wherein when the brightness change information indicates that a state has changed from a high brightness state to a low brightness state, the voltage boost determining unit determines that the terminal voltage of the second terminal of the light-emitting element is not to be boosted, and the switching circuit connects the power supply circuit and the second terminal of the light-emitting element by the through connection signal line and does not enable the voltage boosting circuit to function, and then, based on the output of the detecting and comparing unit, it is determined whether or not the terminal voltage of the second terminal of the light-emitting element is to be boosted.

* * * * *